US006511131B1

(12) United States Patent
Harnois

(10) Patent No.: US 6,511,131 B1
(45) Date of Patent: Jan. 28, 2003

(54) INTERCHANGEABLE ACCESSORY ANCHORING DEVICE FOR WHEELCHAIR OR THE LIKE

(76) Inventor: Jacques Harnois, 18, rue Lavallée, Sainte-Mélanie Québec (CA), J0K 3A0

( * ) Notice: Subject to any disclaimer, the term of this patent is extended or adjusted under 35 U.S.C. 154(b) by 34 days.

(21) Appl. No.: 09/663,324

(22) Filed: Sep. 15, 2000

(51) Int. Cl.[7] ..... A47C 7/54
(52) U.S. Cl. ..... 297/411.23; 297/188.2
(58) Field of Search ..... 297/153, 135, 297/411.23, 411.2, 411.36, 188.2, 463.1, 440.14; 248/118

(56) References Cited

U.S. PATENT DOCUMENTS

| | | | | |
|---|---|---|---|---|
| 2,418,561 A | * | 4/1947 | Stallcup | |
| 3,265,436 A | * | 8/1966 | Bombard et al. | |
| 4,449,750 A | | 5/1984 | Pultman | 297/188 |
| 4,458,870 A | | 7/1984 | Duncan et al. | 248/279 |
| 4,913,393 A | * | 4/1990 | Wood | |
| 5,074,617 A | | 12/1991 | Maxwell | 297/194 |
| 5,176,393 A | | 1/1993 | Robertson et al. | 280/250.1 |
| 5,207,477 A | | 5/1993 | Maxwell | 297/194 |
| 5,288,093 A | | 2/1994 | Gross | 280/292 |
| D359,258 S | | 6/1995 | Judycki | D12/133 |
| 5,476,241 A | | 12/1995 | Helman | 248/286.1 |
| 5,556,168 A | | 9/1996 | Dinsmoor, III et al. | 297/440.2 |
| 5,597,148 A | | 1/1997 | Gospodarich | 248/311.2 |
| 5,634,650 A | | 6/1997 | Hensler et al. | 280/47.38 |
| 5,779,118 A | | 7/1998 | Douglass | 224/407 |
| 5,823,976 A | * | 10/1998 | Cain et al. | |
| 5,839,136 A | * | 11/1998 | Vance et al. | |
| 5,864,902 A | * | 2/1999 | Rogers | |
| 5,893,607 A | * | 4/1999 | Timnell | |
| 5,906,416 A | | 5/1999 | Rasmussen | 297/452.33 |
| 5,947,428 A | | 9/1999 | Ohl | 248/118 |

* cited by examiner

*Primary Examiner*—Milton Nelson, Jr.
(74) *Attorney, Agent, or Firm*—St. Onge Steward Johnston & Reens LLC

(57) ABSTRACT

An anchoring device for anchoring an interchangeable accessory to a tube of an arm of a chair where an elongated cushion is fastened on top of the tube, or another tube of a chair, wheelchair or railing of an hospital bed. Such an anchoring device is useful for alternatively anchoring a table, a joystick, a channel armrest and other desired accessory. The accessory is provided with at least one male element or is fastened to an accessory adaptor having at least one male element. The device has an attaching mechanism for removably attaching the device to a portion of the tube underneath the cushion or to a free section of a tube. The device also has at least one female element corresponding in shape and size to the at least one male element of the accessory for co-operating with the at least one male element. A securing mechanism is provided for securing the at least one male element into the at least one female element when inserted into the at least one female element.

17 Claims, 6 Drawing Sheets

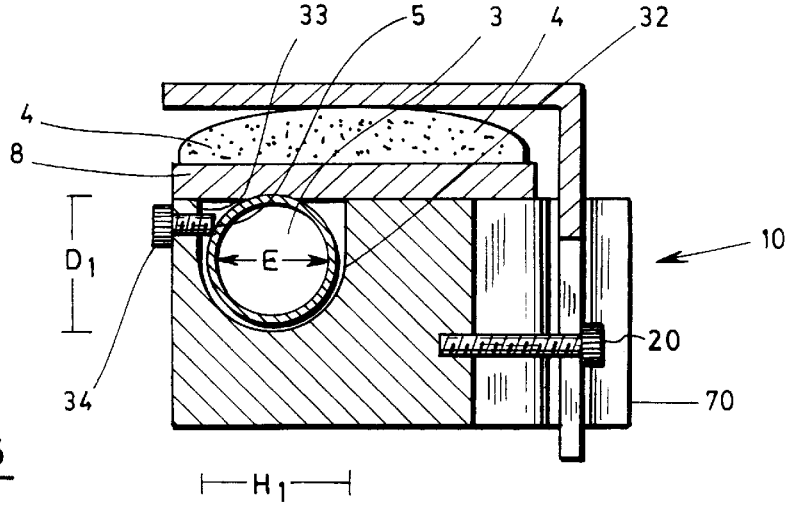
FIG. 5
FIG. 6
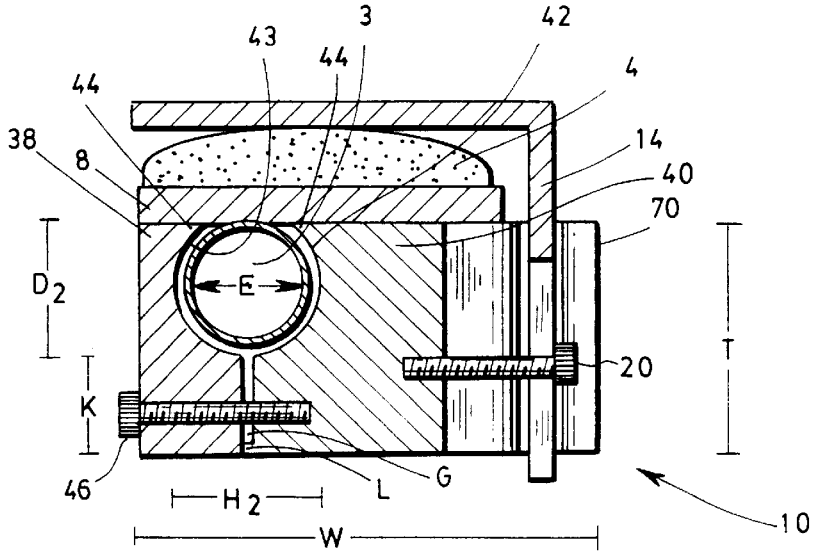
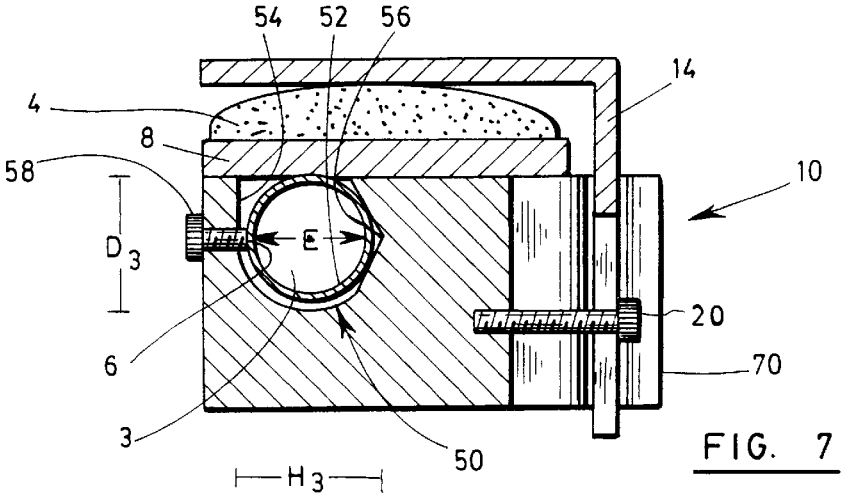
FIG. 7

FIG. 10
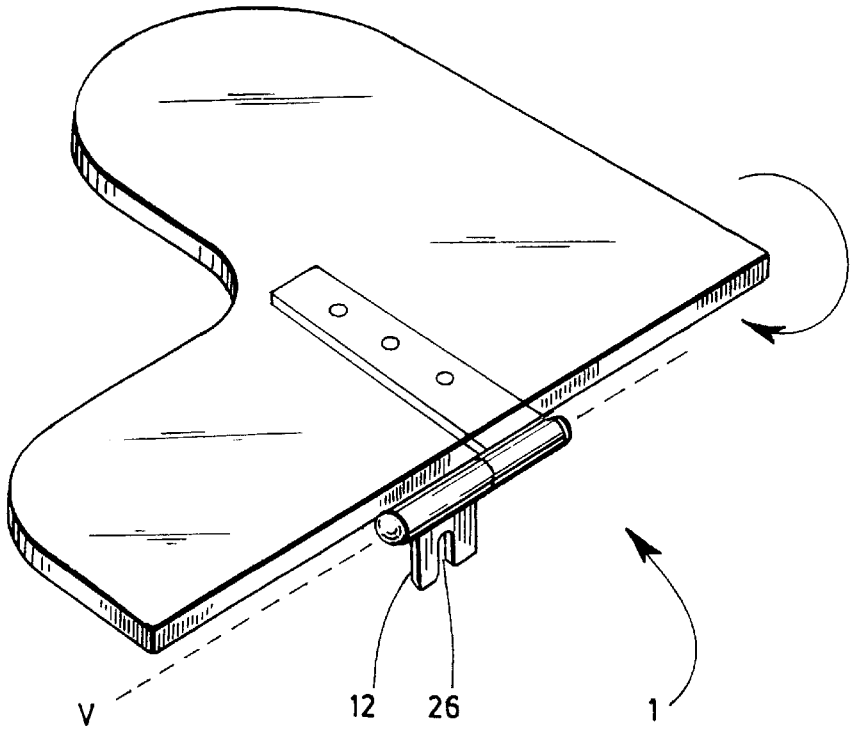
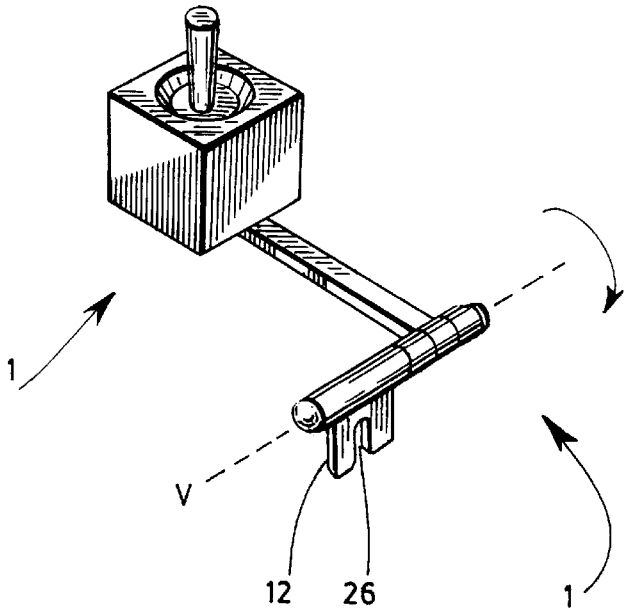
FIG. 11

INTERCHANGEABLE ACCESSORY ANCHORING DEVICE FOR WHEELCHAIR OR THE LIKE

FIELD OF THE INVENTION

The present invention is directed to an anchoring device for alternatively anchoring several accessories to a tube of an arm of a chair, a wheelchair or the like, or to a tube of a side panel of a hospital bed or the like. The anchoring device of the present invention is compact, provides a strong attachment to the tube and an easy handling mechanism for anchoring an accessory. The anchoring device can be used for various accessories such as a swivelling table, a joystick and a channel armrest for a users forearm One preferred embodiment of the anchoring device is designed specifically for an arm of a chair or wheelchair so that it does not interfere with the cushion of the arm, and there is thus no need to remove the cushion when attaching the device.

BACKGROUND

When a person is confined to a wheelchair, it is sometimes necessary to attach, or removably attach, an accessory to the chair to give the person greater autonomy, or for safety or comfort reasons. Such accessories can be a swivelling table, used mainly for writing, reading or eating; or alternatively, a joystick which controls the motor and direction of a motorized wheelchair, or alternatively, for operating a computer or like devices, or alternatively a channel armrest used mainly for holding the user's forearm on the wheelchair arm.

Presently, accessories for wheelchair or other items made with a tubular structure, have their own anchoring mechanism to the wheelchair and do not allow to interchange an accessory for another without removing the anchoring mechanism, such as the devices described in U.S. Pat. No. 4,449,750; U.S. Pat. No. 4,458,870; U.S. Pat. No. 5,288,093; U.S. Pat. No. 5,476,241; U.S. Pat. No. 5,556,168; U.S. Pat. No. 5,597,148; U.S. Pat. No. 5,779,118; and U.S. Des. 359,258.

Of interest is U.S. Pat. No. 5,947,428 to OHL, which describes a clamping system used for supporting interchangeable accessories for use with standard healthcare equipment. The system uses a mounting bracket which is permanently installed to a piece of furniture. A slip-coupling is removably installed on a support rod depending from this mounting bracket. The system of OHL requires a permanent modification to the piece of furniture to which it is mounted. Furthermore, the conception of the system by definition involves a huge number of parts and does not seem to be straightforward to install and use. Finally, by definition, the system of OHL requires an additional support rod to which are removably attached the clamping system for supporting the accessories.

Other solutions, in order to attach the accessory, require removal of the existing cushion, as taught in the following patents: U.S. Pat. No. 5,074,617 and U.S. Pat. No. 5,207,477.

Both of the above solutions are inefficient in that they are not adapted to remove a variety of accessories on a given holder, interfere with the existing structure of the wheelchair, are permanently attached thereto, require removal of parts of the wheelchair, such as a cushion or make use of a secondary support rod.

There is a need for an anchoring device that can alternatively anchor interchangeable accessories or that does not interfere with the cushion of the wheelchair arm when installed on such an arm having a cushion.

SUMMARY OF THE INVENTION

A main feature of the present invention is providing an anchoring device for anchoring an interchangeable accessory. A subsidiary feature of the present invention is providing an anchoring device that can be attached to a wheelchair arm without interfering with the cushion.

In accordance with the present invention, this object is achieved with an anchoring device for anchoring an interchangeable accessory to an arm of a chair where the arm is of the type comprising a tube and an elongated cushion fastened on top of the tube, and where the accessory is provided with at least one male element. The device comprises:

- attaching means for removably attaching the device to a portion of the tube underneath the cushion;
- at least one female element corresponding in shape and size to the at least one male element of the accessory for co-operating with said at least one male element, the at least one female element having an opening lying in a plane outside an area defined by the cushion; and
- securing means for securing the at least one male element into the at least one female element when inserted into the at least one female element.

In accordance with the present invention, this object is also achieved with an anchoring device for anchoring an interchangeable accessory to a tube of a chair or an hospital bed where the accessory is provided with at least one male element. The device comprises:

- attaching means for removably attaching the device to a section of the tube;
- at least one female element corresponding in shape and size to the at least one male element of the accessory for co-operating with said at least one male element, the at least one female element having an opening; and
- securing means for securing the at least one male element into the at least one female element when inserted into the at least one female element.

The present invention is also directed to a combination of an anchoring device as above-defined and an accessory that includes the at least one male element corresponding in shape and size to the at least one female element of the device for mating with said at least one female element.

The present invention is further directed to a combination of an anchoring device as above-defined and an accessory adaptor. The accessory adaptor comprises:

- a plate being securable to an accessory, and
- at least one male element extending downwardly from the plate and corresponding in shape and size to the at least one female element of the device for mating with said female element.

The invention and its advantages will be better understood after reading the non restrictive description of the preferred embodiments of the invention. This description is given with reference to the appended drawings.

BRIEF DESCRIPTION OF THE DRAWINGS

FIG. 5 is cross-sectional view of an anchoring device according to a first preferred embodiment of the invention with an accessory adaptor mounted on a wheelchair arm.

FIG. 6 is cross-sectional view taken along line VI—VI of FIG. 2.

FIG. 7 is cross-sectional view of an anchoring device according to a third preferred embodiment of the invention with an accessory adaptor mounted on a wheelchair arm.

FIG. 10 is a perspective view of a second accessory having a male element according to a preferred embodiment of the invention.

FIG. 11 is a perspective view of a third accessory having a m ale element according to a preferred embodiment of the invention.

DESCRIPTION OF THE PREFERRED EMBODIMENTS OF THE INVENTION

Figure 1:
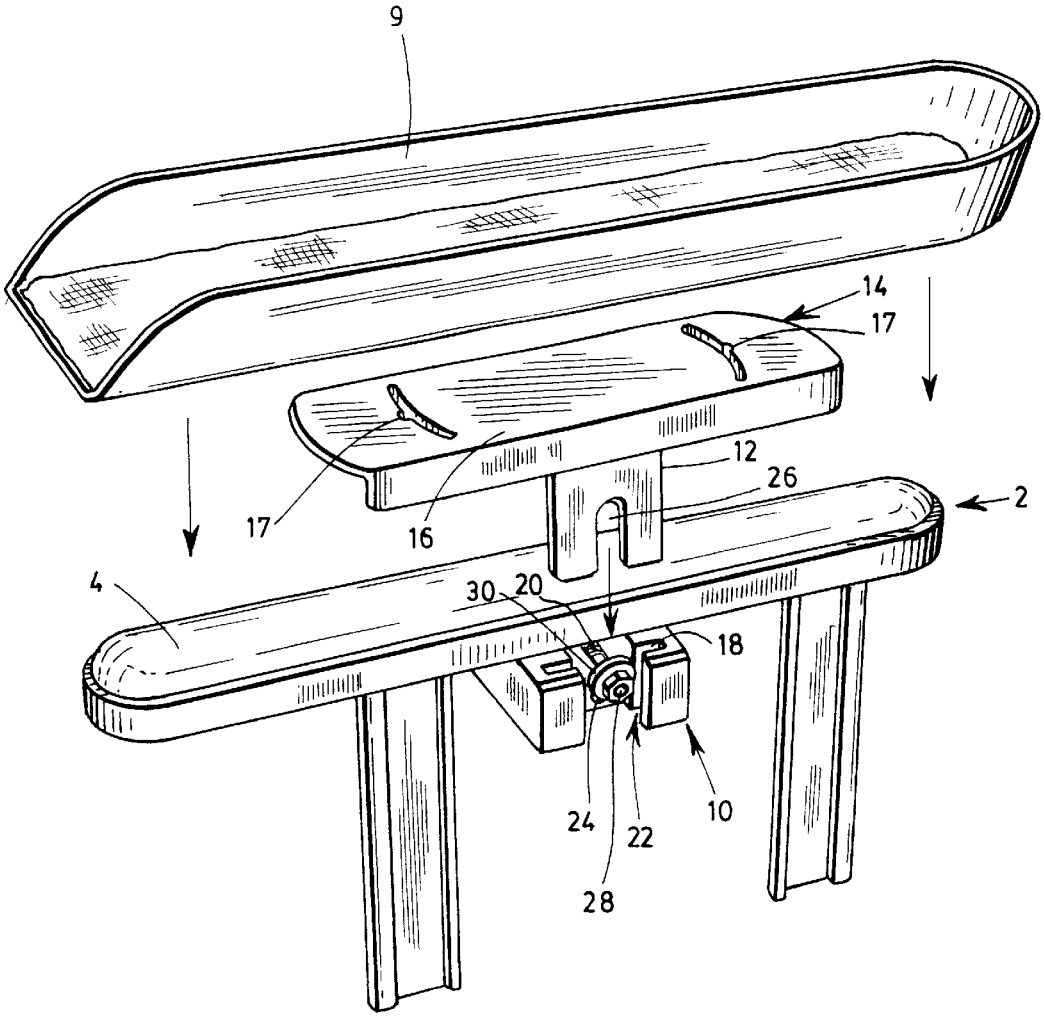
FIG. 1 is a top exploded perspective view of an accessory, an accessory adaptor according to a preferred embodiment of the present invention, a wheelchair arm and an anchoring device according to preferred embodiment of the present invention.

Referring to FIGS. 1 and 10, the present invention concerns an anchoring device (10) for anchoring an interchangeable accessory (9) to an arm (2) of a chair (not shown). Typically, as is well known, a wheel chair arm (2) includes a tube (3), or other rigid structure, on which is secured a cushion, or armrest. The tube (3) has a longitudinal axis A shown in FIG. 4, and generally has a circular cross-section but it may also have a more or less square or oval cross-section. The tube (3) when circular or oval, thus has an equator E (shown in FIGS. 5 and 6), which, for the purposes of the present description, is meant to designate that area of the tube (3) which, when looking at a cross-sectional view, is the widest.

The word <<chair>> in the context of the present description is used to designate a wheelchair, motorized or not, a chair or any other seating means or resting means having an arm (2) as above-described. The invention, as will be seen, can also be used with a railing of a hospital bed, or any other type of railing when it is desirable to removably attach an accessory.

As shown in FIG. 10, the accessory (1) is provided with at least one male element (12). In the case of FIG. 1, the at least one male element (12) is part of an accessory adaptor (14) which is fastened to an accessory (9). Still referring to FIG. 1, the accessory adaptor (14) comprises a plate (16) being securable under an accessory (1); and at least one male element (12) extending downwardly from the plate (16) and corresponding in shape and size to an at least one female element (22) of the device (10), for mating with the female element (22). The plate (16) of the adaptor (14) is preferably provided with holes (17) for allowing the use of screws to secure the accessory (9). The holes (17) preferably have an elongated rounded shape for adjusting the angle of the accessory (1) with respect to the adaptor (14).

It should be understood that a feature of the accessory (1) is that it is interchangeable i.e. that various accessories can be placed no the device (10 of the present invention. According to the invention, this feature is dictated by the use of a male element (12) compatible with the female element (22) of the anchoring device (10). Like the accessory (1) shown in FIG. 10, several accessories can be manufactured with at least one male element (12) as an integral part thereof. However, the invention also concerns an accessory adaptor (14) that can be fastened under a variety of accessories (9) that already exist. Using accessories (1) manufactured with at least one male element (12) or known accessories (9) fastened to adaptors (14), it is understood that these can be interchanged and alternatively used with the anchoring device (10) of the present invention.

The present invention is useful to anchor accessories such as a swivelling table (illustrated in FIG. 10), a joystick (illustrated in FIG. 11) and a channel armrest for a user's forearm (illustrated in FIG. 1). The table shown in FIG. 10 can swivel about an axis V to clear to the place in front of the user. Similarly, the joystick shown in FIG. 11 can also swivel about the axis V. Of course, the present invention can be used to anchor other accessories without departing from the scope of the invention.

According to the preferred embodiments of the present invention shown in FIGS. 1 to 7, the anchoring device (10) is designed for anchoring an interchangeable accessory (1) or accessory adaptor (14) to an arm (2) of a chair, where the arm (2) is of the type comprising a tube (3) and an elongated cushion (4) fastened on top of the tube (3).

The anchoring device (10) comprises attaching means for removably attaching the device (10) to a portion of the tube (3) underneath the cushion (4). The portion of the tube (3) is defined as covering a part of its circumference along a certain length of the tube (3). In other words, the portion of the tube (3) is an accessible part of the tube (3) under the cushion (4). Three different embodiments of the attaching means for removably attaching the device (10) to a portion of the tube (3) underneath the cushion (4) will described hereinbelow and will be referred as the first, second and third preferred embodiments of the invention.

Figure 2:
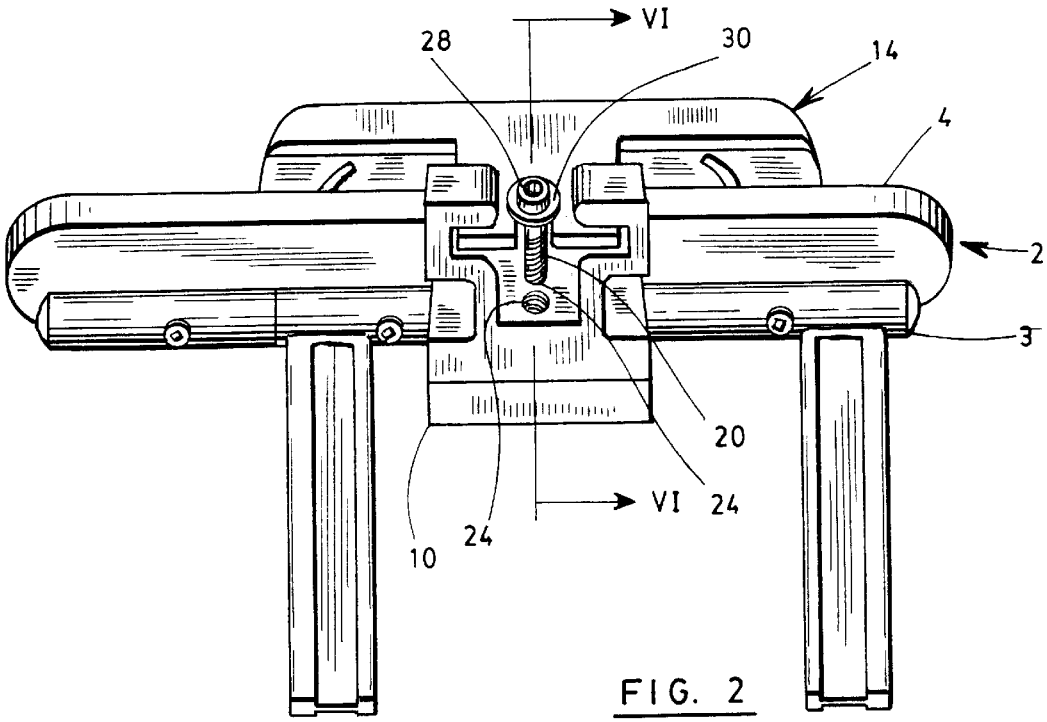
FIG. 2 is a bottom perspective view of an accessory adaptor and an anchoring device according to a second preferred embodiment of the present invention mounted on a wheelchair arm.

Referring to FIGS. 1 and 2, the anchoring device (10) also comprises at least one female element (22) corresponding in shape and size to the at least one male element (12) of the accessory (1) or the accessory adaptor (14) for co-operating with said at least one male element (12). The at least one female element (22) has an opening (18) lying in a plane S (shown in FIG. 4) outside an area defined by the cushion (4). This is so that the opening (18) is not obstructed by the cushion (4) and free access is provided to the opening (18). Preferably, as shown on FIG. 4, the plane S is horizontal.

The anchoring device (10) further comprises securing means for securing the at least one male element (12) into the at least one female element (22) when inserted into the at least one female element (22). Preferably, the male element can also be adjustably secured in the female element, as will be explained hereinafter.

Figure 4:
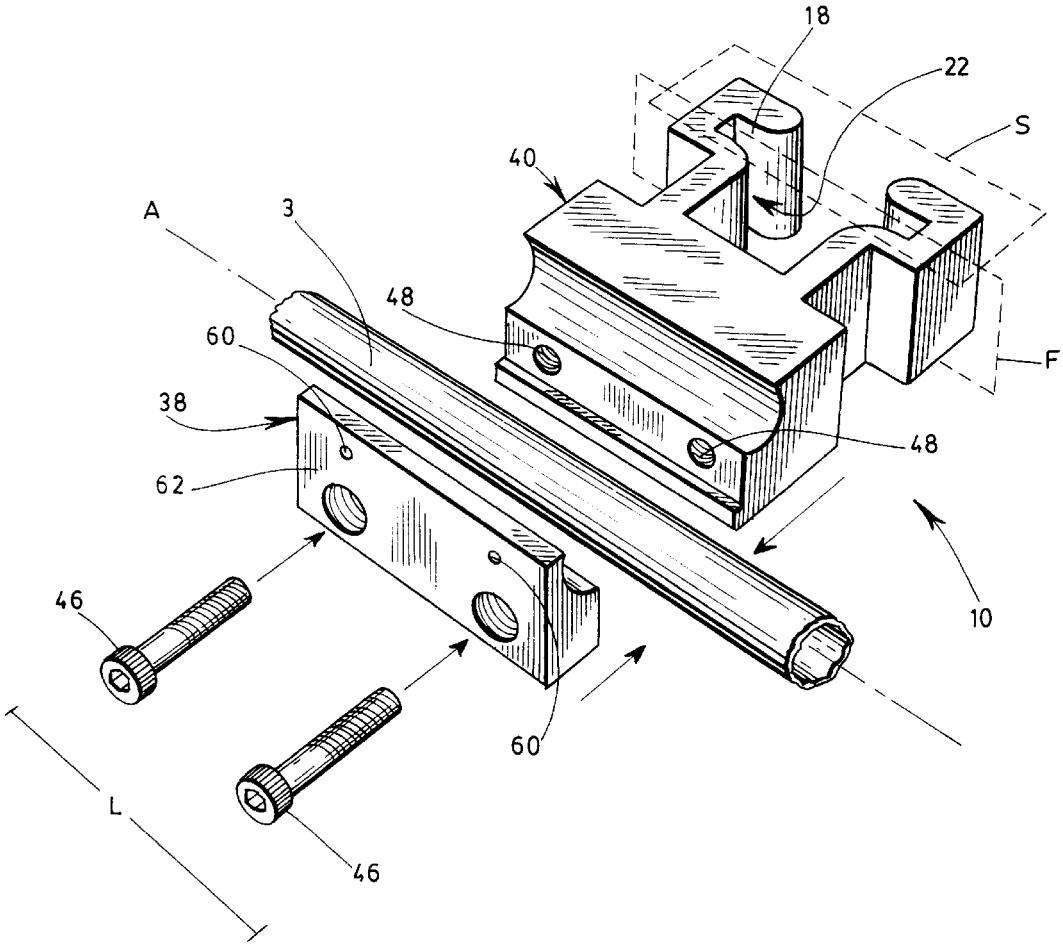
FIG. 4 is a top exploded perspective view of an anchoring device according to a second preferred embodiment of the invention for mounting about a tube.

Referring to FIG. 4, the at least one female element (22) preferably lies in a plane F which is parallel to a longitudinal axis A of the tube (3) so that the outside (70) of the device (10) does not interfere with other peripheral objects. More particularly, as shown in FIGS. 5 to 7, the outside (70) of the device (10) does not considerably project outwardly. However, the plane F may be perpendicular to the axis A, but it is not an optional solution. Preferably, the plane F of the at least one female element (22) is vertical and the plane S of the opening (18) of the at least one female element (22) is horizontal. Consequently, the securing means are advantageously adapted to vertically adjust the at least one male element (12) in the at least one female element (22). The vertical adjustment possibility of the male element (12) will be explained hereinbelow with respect of the securing means.

Referring to FIGS. 1 and 2, the accessory (1) or the adaptor (14) preferably has one male element (12) which is a downwardly extending tongue (12). The device (10) preferably has one female element (22), which is a vertical slot (22). In another preferred embodiment (not shown), the accessory (1) or the adaptor (14) has two male elements which are two downwardly extending rods, and the device (10) preferably has two female elements being two vertical hollow cylinders or rings for receiving each rod respectively. Of course, other shapes and number of male and female elements can be designed as long as they can co-operate together to removably anchor the accessory (1) or accessory adaptor (14), to the device (10).

Still referring to FIGS. 1 and 2, the securing means for securing the downwardly extending tongue (12) into the vertical slot (22), comprise a screw (20) extending in a transversal direction from the device (10) and across the slot (22) and being adapted to be inserted in a threaded hole (24) in the device (10).

Referring to FIG. 1, the securing means further comprise a vertical slit (26) in the tongue (12) of the accessory (1) or the accessory adaptor (14). The slit (26) is downwardly opened so that the screw (20) extends through the slit (26) when the tongue (12) is inserted into the slot (22). The screw (20) has a screw head (28) that presses against the tongue (12) when the screw (20) is screwed into the threaded hole (24) of the device (10) i.e. the width of the slit (26) is larger than the diameter of the screw body (20), but smaller than the diameter of the screw head (28). A bearing (30) can be used between the screw head (28) and the tongue (12) as shown in FIGS. 1 and 2 for avoiding friction on the tongue (12). The washer (30) can also be useful as an extension of the head (28) for pressing on the tongue (12).

It is preferred that the accessory (1) or the accessory adaptor (14) rests against the cushion (4) of the arm (2) of the chair (not shown) so that the accessory (1 or 9) is inordinately raised, which is uncomfortable for a user. Different cushions (4) exist and have various thicknesses. Thus, vertically adjusting the accessory (1) or the adaptor (14) allows them to rest against the cushion. Such vertical adjustment of the accessory (1) or the accessory adaptor (14) is provided by the elongated slit (26) in the tongue (12) and also by having the possibility of screwing the screw (20) at different heights. It can be noted on FIGS. 1 and 2 that the device (10) has two threaded holes (24) for alternatively screwing the screw (20) in one or the other. The one in which the screw (20) is inserted can not be seen but the other hole (24) can be seen under the screw (20). The downwardly extending tongue (12) of the adaptor (14) shown in FIG. 1 is not excessively long and depending on the thickness of the cushion (4) it is more appropriate to use one hole (24) or the other to reach the tongue (12) and extend across its slit (26).

It should be understood that the plane F of the at least one female element (22) can also be horizontal and the plane S of its opening (18), vertical. In such a configuration, it is possible to horizontally adjust the at least one male element (12) of the accessory (1) or the accessory adaptor (14) in the at least one female element (22).

Advantageously, as mentioned previously, the device (10) according to the preferred embodiments of the invention, is compact. Preferably, the side (72) of the device (10) illustrated in FIG. 3 does not extend further than the cushion (4) as shown in FIGS. 5, 6 and 7, and is the one that faces the user. The outside (70) of the device (10) that includes the opening (18) of the at least one female element (22) is preferably as close as possible to the arm (2) to minimize interference with the environment or with the user's forearm.

In order to define the environment of the attaching means according to the first, second and third embodiments described below, it is useful to establish that the device (10) has a length L shown in FIG. 4, and a width W and a thickness T shown in FIG. 6; and that the tube (3) has a length, a circumference that can be seen in FIGS. 5 to 9 and an equator E shown in FIGS. 5 and 6.

FIGS. 5, 6 and 7 show the first, second and third embodiments of the present invention, where the anchoring device (10) is designed for anchoring an accessory (1) or an accessory adaptor (14) to a tube (3) having an elongated cushion (4) fastened on top as previously described. In FIGS. 5, 6 and 7, only the accessory adaptor (14) is illustrated for the sake of simplicity and clarity of the drawings.

According to a first preferred embodiment shown in FIG. 5, the attaching means comprise an upwardly opened U-shaped groove (32) provided in the device (10). The groove (32) has a width $H_1$ and a depth $D_1$ adapted to receive a portion of the tube (3) therein. The attaching means according to the first embodiment further comprise a retainer (34) for retaining the tube (3) in the groove (32). The retainer (34) projects from an inner surface (33) of the U-shaped groove (32) and abuts on a location (5) on the tube (3) which is higher that the equator E of the tube (3). Preferably, the retainer (34) is a screw (34) that extends outside the device (10) so that the device (10) can be securely attached to the tube (3), and removed therefrom. If the device (10) or the accessory (1) so require it, the device (10) can be provided with more than one retainer (34) for increased solidity and stability.

According to a second embodiment shown in FIG. 6, the device (10) comprises a first (38) and second (40) parts on both sides of a longitudinal axis. The longitudinal axis between the first and second parts (38, 40) is not shown but it is parallel to the length L of the device (10) shown in FIG. 4. The first and second parts (38, 40) are separable. The attaching means are defined by an upwardly opened C-shaped groove (42) formed by the two parts (38, 40). The C-shaped groove (42) has a width $H_2$ and a depth $D_2$ adapted to receive the portion of the tube (3) therein so that once the device (10) is fastened about the tube (3), friction prevents it from rotating. In order to increase the friction, the groove (42) can be partially or completely lined with a friction increasing material such as rubber. The C-shaped groove (42) has two top edges (44) which lie above the equator E of the tube (3). The top edges (44) are separated by a distance smaller than the diameter of the tube i.e. smaller than the equator E, and thus partially surround the tube (3). The attaching means according to the second embodiment further comprise a lock (46) for locking the first and second parts (38, 40) together about the tube (3). Preferably, the lock (46) is embodied by two screws (46) crossing the first part (38) and screwed in threaded holes (48) in the second part (40) as shown in FIG. 4, but other means for securing the two parts (38, 40) together will be apparent to a person skilled in the art.

In the second embodiment, one half of the C-shaped groove (42) is made in the first part (38) and the other half is made in the second part (40). However, the groove (42) can be split in a proportion other than 50—50, as long as the groove (42) can be widened by separating the two parts (38, 40) and closed to secure the tube (3) therein.

Still according to the second preferred embodiment of the invention shown in FIG. 6, a gap G can be provided between the two parts (38, 40), which does not extend the whole thickness K. As can be seen, the second part (40) is provided with a longitudinal flange L. The gap G and the flange L co-operate to urge the top edges (44) of the groove (42) together when the two parts (38, 40) are locked together i.e. the parts (38, 40) pivot about an axis defined by the flange L.

According to a third preferred embodiment shown in FIG. 7, the attaching means comprise an upwardly opened groove (50) provided in the device (10). The groove (50) has an inner surface (52) comprising a vertical flat wall (54) and an opposite concave wall (56). Preferably, the concave wall (56) has a pointed shape. The groove (50) has a width $H_3$ and a depth $D_3$ adapted to receive the portion of the tube (3) therein. The attaching means according to a third embodiment further comprise a retainer (58) for retaining the tube (3) in the groove (50). The retainer (58) projects from the vertical flat wall (54) of the U-shaped groove (50) and abuts on a location (6) of the tube (3) which preferably corresponds with the equator E of the tube (3) in order to wedge to tube (3) against the tapered concave wall (56). Preferably, the retainer (58) is a screw (58) that extends outside the device (10) for allowing adjustment. Again, should the needs dictate it, the device (10) can be provided with more than one retainer (58).

As can be seen in FIGS. 5, 6 and 7, the anchoring device (10) is flush with the bottom structure (8) of the cushion (4) but this is not necessary. In other words, the anchoring device (10) does not need to be flush with the bottom structure (8) of the cushion (4) to firmly to firmly attach the tube (3). Thus, a gap can be provided between the bottom structure (8) of the cushion (4) and the anchoring device (10) without departing from the scope of the present invention.

Figure 3:
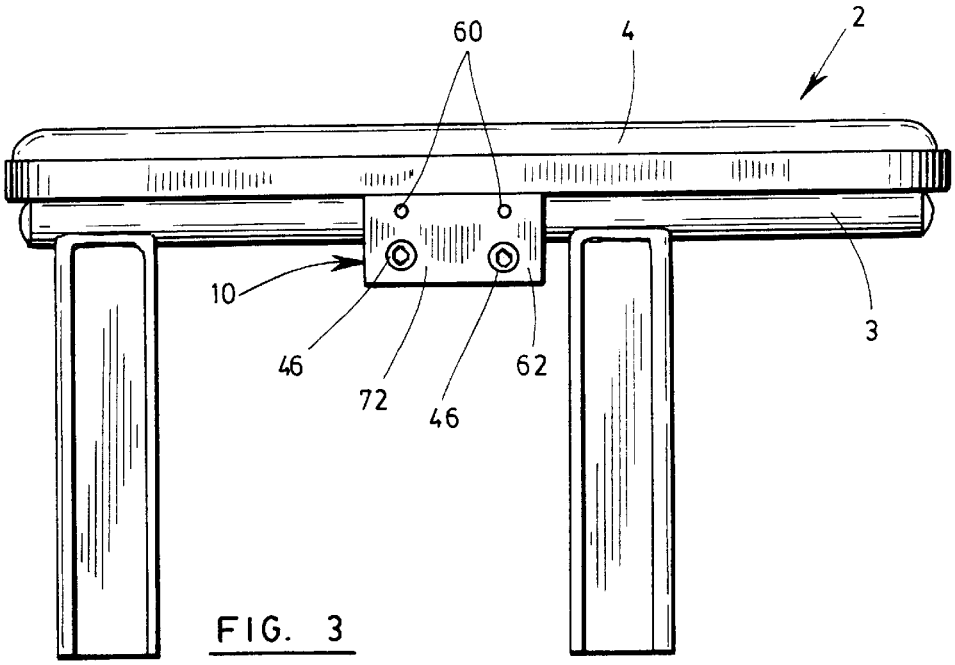
FIG. 3 is an inside view of an anchoring device according to a preferred embodiment of the present invention mounted on a wheelchair arm.

In order to solidify the attachment of the anchoring device (10) to the tube (3), the attaching means according to the first, second and third embodiments can be supplemented by an additional attaching means. Referring to FIGS. 3 and 4, the additional attaching means comprise at least one straight hole (60) from an outside surface (62) of the device (10) through an inner surface (33, 43 and 52 indicated FIGS. 5, 6 and 7 respectively) of the groove (32, 42 or 50 indicated FIGS. 5, 6 and 7 respectively) for allowing a screw (not shown) with an auger bit tip to reach the tube (3) and to be screwed therein. This of course alters the structure of the tube (3), but does not prevent the device (10) from being removable.

The anchoring device (10) can be attached to other tubes that exist on the chair or on an additional tube supplemented to the chair. Such a known additional tube is already used on wheelchair for supporting a joystick and is positioned parallel to one arm of the wheelchair and fixed to the wheelchair's arm. The anchoring device (10) according to the first, second and third embodiments may be used on such an additional tube for anchoring a and therefore, it may replace the joystick holder known in the market.

However, a fourth preferred embodiment and a fifth preferred embodiment of the present invention have been conceived to better satisfy the needs of an anchoring device (10') adapted to be attached to a free section of a tube on which no cushion or other elements are mounted. Such a free section of a tube could be any tube of the structure of a chair or of a side panel of an hospital bed, or the like. The tube can be horizontal, vertical or otherwise oriented.

Figure 8:
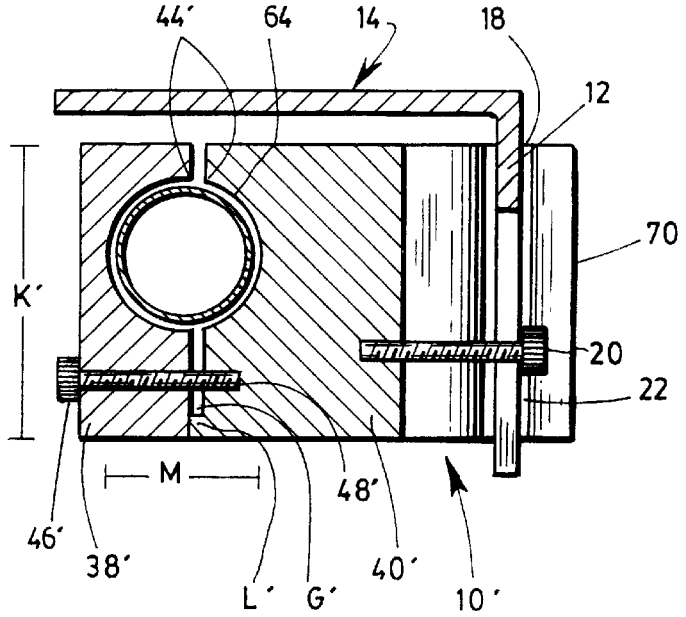
FIG. 8 is cross-sectional view of an anchoring device according to a fourth preferred embodiment of the invention with an accessory adaptor mounted on a tube.
Figure 9:
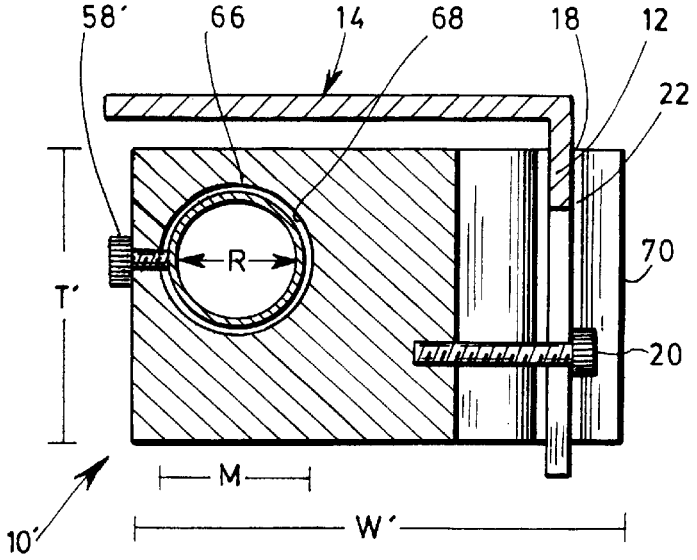
FIG. 9 is cross-sectional view of an anchoring device according to a fifth preferred embodiment of the invention with an accessory adaptor mounted on a tube.

Thus, referring to FIGS. 8 and 9, the present invention also concerns an anchoring device (10') for anchoring an interchangeable accessory (identified as reference numeral 1 in FIG. 1) or an accessory adaptor (14) to a tube (3). The accessory (identified as reference numeral 1 in FIG. 1) or the adaptor (14) is provided with at least one male element (12). An accessory (1) fastened on an accessory adaptor (14) may also be used alternatively as explained above, but only the accessory adaptor (14) is illustrated in FIGS. 8 and 9 for the sake of simplicity and clarity.

The device (10') comprises attaching means for removably attaching the device (10') to a section of the tube (3). The section of the tube (3) is defined as covering its circumference along a predetermined length of the tube (3).

Referring to FIGS. 8 and 9, the device (10'), similarly to the above described device (10), also comprises at least one female element (22) corresponding in shape and size to the at least one male element (12) of the accessory (1) or the accessory adaptor (14) for co-operating with the at least one male element (12). The at least one female element (22) has an opening (18) which is accessible for inserting the at least one male element (12).

As above described for the device (10), the device (10') further comprises securing means for securing the at least one male element (12) into the at least one female element (12) when inserted into the at least one female element (12).

The preferred embodiments of the female element (22) and the securing means are described hereinabove.

In order to define the environment of the attaching means according to the fourth and fifth preferred embodiments described below, it is useful to state that the device (10') has a length (not shown), a width W' and a thickness (T' ) shown in FIG. 8; and that the tube (3) has a length (not shown), a circumference that can be seen in FIGS. 8 and 9 and a diameter R shown in FIG. 8.

According to the fourth preferred embodiment shown in FIG. 8, the device (10') comprises a first (38') and second parts (40') on both sides of a longitudinal axis (not shown). The first and second parts (38' and 40') are separable. The attaching means are defined by a longitudinal tubular hole (64) formed by the two parts (38' and 40'). The tubular hole (64) has a diameter M adapted to snugly receive the section of the tube (3) therein so that once the device (10') is fastened about the tube (3), friction prevents it from rotating. In order to increase the friction, the tubular hole (64) can be partially or completely lined with a friction increasing material such as rubber. The attaching means further comprise a lock (46') for locking the first and second parts (38', 40') together about the tube (3). Preferably, the lock (46') is embodied by two screws (46') crossing the first part (38') and screwed in threaded holes (48') in the second part (40) as shown in FIG. 8.

Still according to the fourth preferred embodiment of the invention shown in FIG. 8, a gap G' can be provided between the two parts (38', 40'), which does not extend the whole thickness K'. As can be seen, the second part (40') is provided with a longitudinal flange L'. The gap G' and the flange L' co-operate to urge the topmost edges (44') of the tubular hole (64) together when the two parts (38', 40') are locked together i.e. the parts (38', 40') pivot about an axis defined by the flange L'.

According to the fifth preferred embodiment shown in FIG. 9, the attaching means comprise a longitudinal tubular hole (66) provided in the device (10'). The tubular hole (66) has a diameter M adapted to receive the section of the tube (3) therein. The attaching means further comprise a retainer (58') for retaining the tube (3) in the hole (66). The retainer projects from an inner surface (68) of the tubular hole (66) and abuts on the tube (3). Again, should the needs dictate it, the device (10') can be provided with more than one retainer (58').

In order to solidify the attachment of the anchoring device (10') to the tube (3), it is also possible to supplement the attaching means according to the fourth and fifth preferred embodiments by an additional attaching means similar the one above-described with respect to the first, second and third preferred embodiments. Such additional attaching means is not shown on the fourth and fifth preferred embodiments illustrated in FIGS. 8 and 9. However, it should be understood that such an additional attaching means comprise at least one straight hole (not shown) from outside the device (10') to the tube (3) for allowing a screw (not shown) with an auger bit tip to reach the tube (3) and to be screwed therein. Again, this of course alters the structure of the tube (3), but does not prevent the device (10') from being removable.

The present invention further concerns the combination of an accessory (1) or an accessory adaptor (14) with an anchoring device (10) designed for an arm (2) of a chair (not shown) a tube (3) having a cushion (4) fastened on top.

The present invention also further concerns a combination of an accessory (1) or an accessory adaptor (14) with an anchoring device (10') designed for a free tube (3) on which there no cushion (4) or other elements fastened on.

Although preferred embodiments of the invention has been described in detail herein and illustrated in the accompanying drawings, it is to be understood that the invention is not limited to these precise embodiments and that various changes and modifications may be effected therein without departing from the scope of the invention as defined in the appended claims.

What is claimed is:

1. An anchoring device for anchoring an interchangeable accessory to an arm of a chair, the arm comprising a tube and an elongated cushion fastened on top of the tube, the tube having a length, a circumference and an equator, said accessory being provided with at least one male element, the device comprising:

attaching means for removably attaching the device to a portion of the tube underneath the cushion;

at least one female element corresponding in shape and size to the at least one male element of the accessory for co-operating with said at least one male element, the at least one female element having an opening lying in a plane outside an area defined by the cushion when the anchoring device is installed on the arm of a chair;

securing means for securing the at least one male element into the at least one female element when inserted into the at least one female element;

wherein the device has a width, a length and a thickness and comprises first and second parts on both sides of a longitudinal axis, the first and second parts being separable, and wherein the attaching means are defined by:

an upwardly opened C-shaped groove formed by the two parts, the C-shaped groove having a width and a depth adapted to receive the portion of the tube therein, the C-shaped groove having two top edges adapted to lie above the equator of the tube when the anchoring device is installed on the arm of a chair, the top edges being separated by a distance smaller than the diameter of the tube; and a lock for locking the first and second parts together about the tube when the anchoring device is installed on the arm of a chair; and additional attaching means for attaching the device to the portion of the tube, the additional attaching means comprising at least one hole from an outside surface of the device through an inner surface of the groove for allowing a screw with an auger bit tip to reach the tube and to be screwed therein when the anchoring device is installed on the arm of a chair.

2. An anchoring device according to claim 1, wherein the at least one female element lies in a plane parallel to a longitudinal axis of the tube when the anchoring device is installed on the arm of a chair.

3. An anchoring device according to claim 2, wherein the plane of the at least one female element is vertical and the plane of the opening of the at least one female element is horizontal.

4. An anchoring device according to claim 3, wherein the securing means are adapted to vertically adjust the at least one male element in the at least one female element.

5. In combination, an anchoring device as claimed in claim 1, and an accessory, said accessory including the at least one male element corresponding in shape and size to the at least one female element of the device for mating with said at least one female element.

6. A combination according to claim 5, wherein the accessory is selected from the group consisting of a swivelling table, a joystick and a channel armrest for a user's forearm.

7. A combination as claimed in claim 5, wherein the accessory rests on the cushion of the arm of the chair when the combination is installed on the arm of the chair.

8. In combination, an anchoring device as claimed in claim 1, and an accessory adaptor, said accessory adaptor comprising:

a plate being securable to an accessory, and at least one male element extending downwardly from the plate and corresponding in shape and size to the at least one female element of the device for mating with said female element.

9. A combination comprising an anchoring device as claimed in claim 1, and an accessory adaptor, said accessory adaptor comprising:

a plate being securable to an accessory, and at least one male element extending downwardly from an edge of the plate and corresponding in shape and size to the at least one female element of the device for mating with said female element, wherein the plate rests on the cushion of the arm of the chair when the combination is installed on the arm of the chair.

10. An anchoring device for anchoring an interchangeable accessory to an arm of a chair, the arm comprising a tube and an elongated cushion fastened on top of the tube, said accessory being provided with at least one male element, the device comprising:

attaching means for removably attaching the device to a portion of the tube underneath the cushion;

at least one female element corresponding in shape and size to the at least one male element of the accessory for co-operating with said at least one male element, the at least one female element having an opening lying in a plane outside an area defined by the cushion when the anchoring device is installed on the arm of a chair;

securing means for securing the at least one male element into the at least one female element when inserted into the at least one female element;

wherein the at least one female element lies in a plane parallel to a longitudinal axis of the tube when the anchoring device is installed on the arm of a chair;

wherein the plane of the at least one female element is vertical and the plane of the opening of the at least one female element is horizontal;

wherein the accessory has one male element, said male element being a downwardly extending tongue, and wherein the device has one female element, said female element being a vertical slot; and wherein the securing means comprise:

a screw extending in a transversal direction from the device and across the slot and being adapted to be inserted in a threaded hole in the device; and wherein the tongue of the accessory includes a slit, the slit being downwardly opened so that the screw extends through the slit when the tongue is inserted into the slot, the screw having a screw head that presses against the tongue when the screw is screwed into the device.

11. In combination, an anchoring device as claimed in claim 10, and an accessory, said accessory including the at least one male element corresponding in shape and size to the at least one female element of the device for mating with said at least one female element.

12. A combination according to claim 11, wherein the accessory is selected from the group consisting of a swivelling table, a joystick and a channel armrest for a user's forearm.

13. A combination as claimed in claim 11, wherein the accessory rests on the cushion of the arm of the chair when the combination is installed on the arm of the chair.

14. In combination, an anchoring device as claimed in claim 10, and an accessory adaptor, said accessory adaptor comprising:

a plate being securable to an accessory, and at least one male element extending downwardly from the plate and corresponding in shape and size to the at least one female element of the device for mating with said female element.

15. A combination as claimed in claim 14, wherein the accessory adaptor has one male element, said male element being a downwardly extending tongue, and wherein the device has one female element, said female element being a vertical slot.

16. A combination comprising an anchoring device as claimed in claim 10, and an accessory adaptor, said accessory adaptor comprising:

a plate being securable to an accessory, and at least one male element extending downwardly from an edge of the plate and corresponding in shape and size to the at least one female element of the device for mating with said female element, wherein the plate rests on the cushion of the arm of the chair when the combination is installed on the arm of the chair.

17. A combination as claimed in claim 16, wherein the accessory adaptor has one male element, said male element being a downwardly extending tongue, and wherein the device has one female element, said female element being a vertical slot.

* * * * *